US009165465B2

(12) United States Patent
Kosatka-Pioro et al.

(10) Patent No.: US 9,165,465 B2
(45) Date of Patent: Oct. 20, 2015

(54) SYSTEM AND METHOD FOR PROVIDING TRAFFIC INFORMATION

(71) Applicants: Aleksandra Kosatka-Pioro, Lutomiersk (PL); Krzysztof Pioro, Lutomiersk (PL)

(72) Inventors: Aleksandra Kosatka-Pioro, Lutomiersk (PL); Krzysztof Pioro, Lutomiersk (PL)

(73) Assignee: Aleksandra Kosatka-Pioro, Lutomiersk (PL)

( * ) Notice: Subject to any disclaimer, the term of this patent is extended or adjusted under 35 U.S.C. 154(b) by 33 days.

(21) Appl. No.: 14/142,851

(22) Filed: Dec. 29, 2013

(65) Prior Publication Data

US 2015/0054658 A1 Feb. 26, 2015

(30) Foreign Application Priority Data

Aug. 26, 2013 (EP) ..... 13461543

(51) Int. Cl.

| | |
|---|---|
| ***G08G 1/09*** | (2006.01) |
| ***G08G 1/0967*** | (2006.01) |
| ***G08G 1/0962*** | (2006.01) |
| ***G08G 1/096*** | (2006.01) |

(52) U.S. Cl.

CPC ..... *G08G 1/0967* (2013.01); *G08G 1/096* (2013.01); *G08G 1/0962* (2013.01); *G08G 1/09626* (2013.01); *G08G 1/09675* (2013.01); *G08G 1/096716* (2013.01); *G08G 1/096741* (2013.01); *G08G 1/096775* (2013.01); *G08G 1/096783* (2013.01)

(58) Field of Classification Search

CPC ..... G01C 21/00; G01C 21/20; G01C 21/26; G01C 21/36; G01C 21/3679; G01C 21/34; G01C 21/3697; G08G 1/096716

USPC ..... 701/119, 117; 340/905

See application file for complete search history.

(56) References Cited

U.S. PATENT DOCUMENTS

| | | | | |
|---|---|---|---|---|
| 7,734,275 | B2 * | 6/2010 | Kubota et al. | 455/344 |
| 8,410,957 | B2 * | 4/2013 | Mizuno | 340/905 |
| 2004/0068364 | A1 * | 4/2004 | Zhao et al. | 701/201 |
| 2005/0134478 | A1 * | 6/2005 | Mese et al. | 340/901 |
| 2010/0007523 | A1 * | 1/2010 | Hatav | 340/901 |
| 2010/0145569 | A1 * | 6/2010 | Bourque et al. | 701/33 |
| 2012/0209487 | A1 * | 8/2012 | Busch | 701/70 |
| 2013/0110371 | A1 * | 5/2013 | Ogawa | 701/70 |
| 2013/0151028 | A1 * | 6/2013 | Tate, Jr. | 701/1 |
| 2014/0176321 | A1 * | 6/2014 | Chen et al. | 340/435 |
| 2014/0285331 | A1 * | 9/2014 | Otake | 340/435 |

* cited by examiner

*Primary Examiner* — Jennifer Mehmood
*Assistant Examiner* — Rufus Point
(74) *Attorney, Agent, or Firm* — Mark M Friedman

(57) ABSTRACT

A computer-implemented method for providing traffic information via a navigation module onboard a moving vehicle, comprising the steps of: obtaining geolocalization data of the vehicle; identifying the closest traffic light ahead the vehicle; retrieving, from a remote traffic light server, operational information on the identified closest traffic light; processing the operational information to determine an optimal speed at which the vehicle should move to arrive at the closest traffic light when it is at green phase; and outputting the optimal speed via a user interface of the navigation module.

11 Claims, 5 Drawing Sheets

Traffic light: ID_131

| | |
|---|---|
| Next red in: | 10s |
| Next green in: | 30s |
| Green cycle: | 30s |
| Red cycle: | 30s |

SYSTEM AND METHOD FOR PROVIDING TRAFFIC INFORMATION

BACKGROUND OF THE INVENTION

1. Field of the Invention

The object of the present invention is a system and a method for providing traffic information, in order to reduce traffic, optimize travel time and increase safety, especially within city limits.

2. Description of the Related Art

Traffic congestion is a well-known problem, especially in cities with a high number of crossroads. Traffic flow may be optimized by providing systems for management of traffic lights, but these systems have a reactive nature—they may adapt the traffic light to actual traffic conditions, but have limited capabilities of impacting individual vehicles to optimize their movement.

Traffic management systems may be configured as a so-called 'green wave', where the main road has traffic lights configured such that a vehicle moving at a certain speed, for example 50 km/h, will reach the next traffic lights at a green light. The drawback of this system is that each driver shall maintain a particular optimal speed, for example 50 km/h, on the particular section of the road. However, in traffic conditions, a driver must adapt to other vehicles, which often means that it will not be possible to maintain the optimal speed in order to keep with the green wave. This especially happens when road sections between the traffic lights are long.

A U.S. Pat. No. 5,519,390 discloses a traffic light timer, which provides a visible and accurate warning that a traffic light signal is about to change. The time remaining before the change is displayed in numeric form on a display and visibly counts down the seconds remaining. The display can be alphanumeric or graphical, allowing for the display of free form icons. Such timer may allow the driver to adapt the speed of travel to drive optimally, i.e. to slow down when the driver assumes that the light will soon change to red, or to speed up when the driver assumes that there is sufficient time to cross the road at green light. The drawback of the system is that it requires the driver to make own assessments and that it is effective only within the range of the eyesight of the driver.

Taking into account the aforementioned prior art publications, there exists a need to design a system and a method for providing traffic information, which will be useful for optimization of driving speed of individual vehicles and therefore may lead to reduction of overall traffic congestion.

SUMMARY OF THE INVENTION

The following description relates to a computer-implemented method for providing traffic information via a navigation module onboard a moving vehicle, comprising the steps of: obtaining geolocalization data of the vehicle; identifying the closest traffic light ahead the vehicle; retrieving, from a remote traffic light server, operational information on the identified closest traffic light; processing the operational information to determine an optimal speed at which the vehicle should move to arrive at the closest traffic light when it is at green phase; and outputting the optimal speed via a user interface of the navigation module.

Preferably, the optimal speed is determined by: determining the speed range necessary to arrive at the first green cycle of the closest traffic light; comparing the speed range with a speed limit; in case the speed range includes a range lower than the speed limit, determining the optimal speed as not greater than the speed limit; and otherwise, determining the speed range necessary to arrive at the next green cycle of the closest traffic light.

Preferably, the optimal speed is further determined by: determining a second speed range necessary to arrive at the first green cycle of the next traffic light; comparing the second speed range with a speed limit; in case the second speed range includes a range lower than the speed limit, determining the second optimal speed as not greater than the speed limit and outputting an optimal speed which is in the range of intersection of the first speed range and the second speed range; and otherwise, determining the speed range necessary to arrive at the next green cycle of the closest traffic light, Preferably, the speed limit is selected depending on the type of the vehicle.

Preferably, the speed limit is determined as the maximum allowed speed limit determined by a mapping system for the particular road region between the vehicle and the closest traffic light.

Preferably, the speed limit is determined as an average speed stored in a history database for travel between the particular road region between the vehicle and the traffic light.

Preferably, the optimal speed is determined by determining the optimal speed as a speed within a range necessary to arrive at the green cycle of the closest traffic light and the next traffic light.

Preferably, the method further comprises outputting, via a user interface of the navigation module, an indicator specifying whether the current speed is within the calculated speed range, lower than the determined speed range or higher than the determined speed range.

Preferably, the method is operated cyclically.

There is further presented a computer program comprising program code means for performing all the steps of the computer-implemented method as described above when said program is run on a computer, as well as a computer readable medium storing computer-executable instructions performing all the steps of the computer-implemented method as described above when executed on a computer. The computer program may be a software module of the onboard computer of the vehicle.

Furthermore, there is presented a navigation module for providing traffic information for a moving vehicle, the module comprising: a geolocalization module configured to provide geolocalization data of the vehicle; a mapping system configured to identify the closest traffic light ahead the vehicle; a data interface communicatively connected to a remote traffic light server, and configured to retrieve operational information on the identified closest traffic light; a data processor configured to process the operational information to determine an optimal speed at which the vehicle should move to arrive at the closest traffic light when it is at green phase; a user interface configured to output the optimal speed.

BRIEF DESCRIPTION OF DRAWINGS

The system and method are presented by means of an example embodiment in a drawing, in which.

DETAILED DESCRIPTION OF THE PREFERRED EMBODIMENTS

Figure 1:
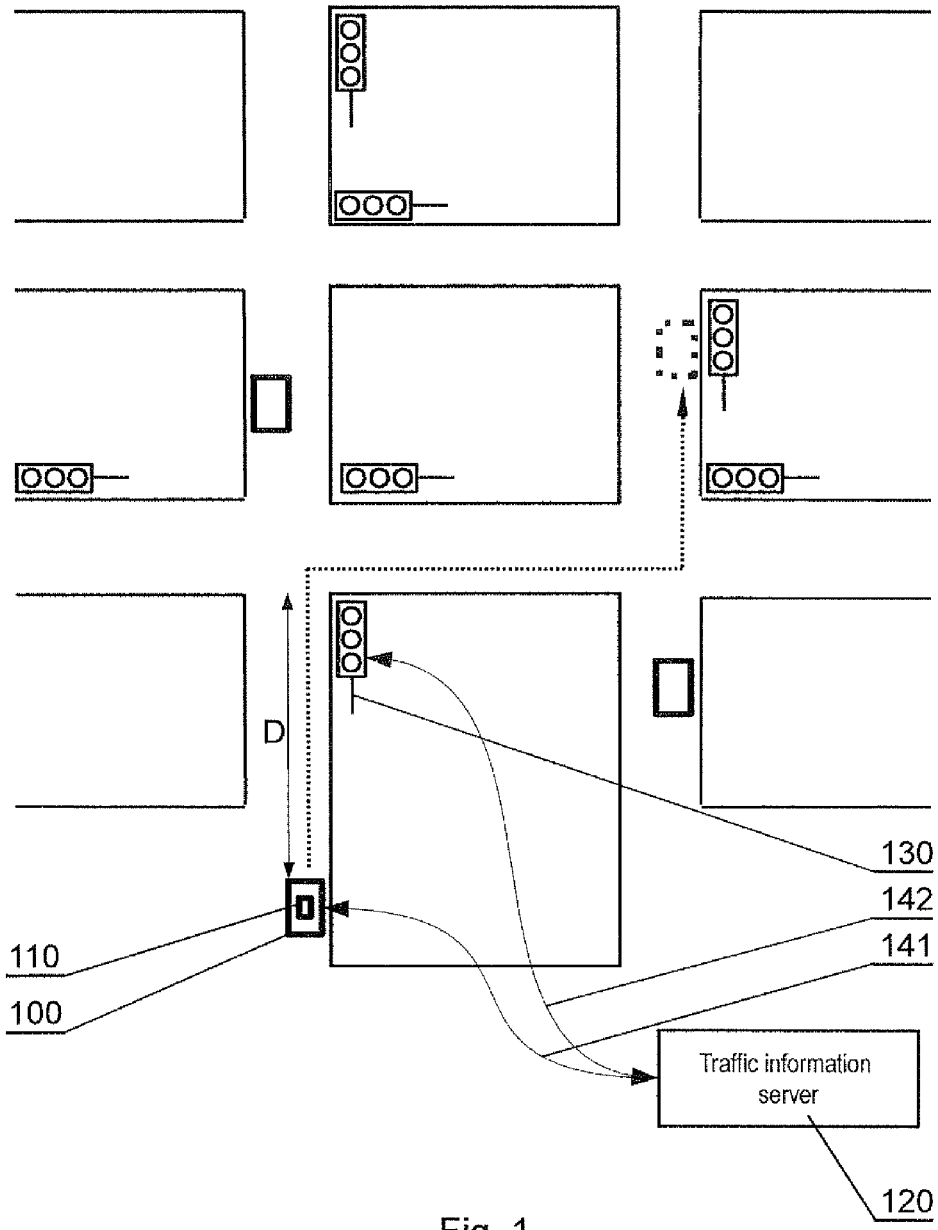
FIG. 1 shows an exemplary traffic situation.

FIG. 1 shows an exemplary traffic situation, wherein a vehicle approaches a traffic light 130 and is currently at a distance D from that traffic light. Vehicles which use the system are equipped with navigation modules 110, which communicate with a traffic information server 120, wherein the server 120 also communicates with the traffic lights 130.

Figure 2:
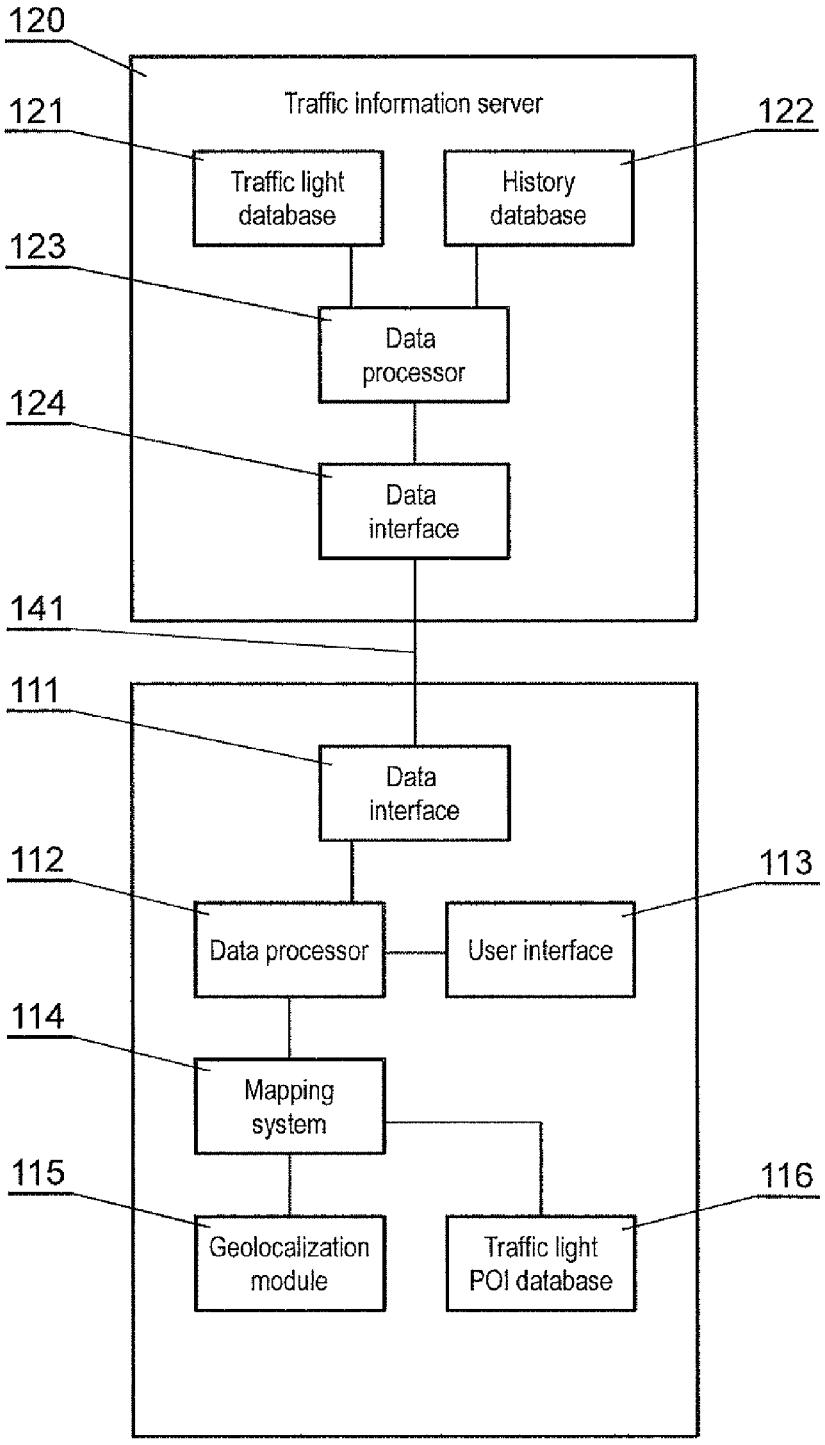
FIG. 2 presents a block diagram of the components of the system.

FIG. 2 presents a diagram of the components of the system.

The traffic information server 120 comprises a traffic lights database 121, which stores, for each traffic light 130 handled by the system, information about light cycle. The content of the information about the light cycle may be dependent on the particular traffic lights management system used. For static systems, the information may include a list of light change times. For adaptive systems, the information may include only information about the next expected light change only, as the light may be operated adaptively to road conditions. The database 121 may also store other information, such as whether the given traffic light 130 is synchronized with the clock of the server 120, information to which lane the traffic light applies, information on time at which the given traffic light is in an idle state (typically at night), information on speed limit in the vicinity of the traffic light. The server 120 is linked with the traffic lights 130 via a communication link 142.

The traffic information server 120 may further comprise a history database 122, configured to store statistical historical data, such as typical travel times between two identified traffic lights, preferably taking into account the time of the day, type of the day (workday, weekend day, national holiday etc.). The history database 122 may be compiled based on information requests gathered from vehicles 100, as will be explained further.

Information from the traffic lights database 121 provides data describing current parameters of the environment, which are theoretical and may be not achievable in practice. For example, the speed limit allowable within the vicinity of the light may be in practice impossible to achieve in rush hours. The data from the traffic lights database 121 may be therefore corrected by data from historical database 122, e.g. specifying that the average achievable maximum speed in a particular rush hour is e.g. 10 km/h lower than the actual speed limit.

Data from the databases 121, 122 is processed by a data processor 123 and made accessible to users of the system by a data interface 124 as operational information on a particular traffic light 130.

Figures 3, 4A:
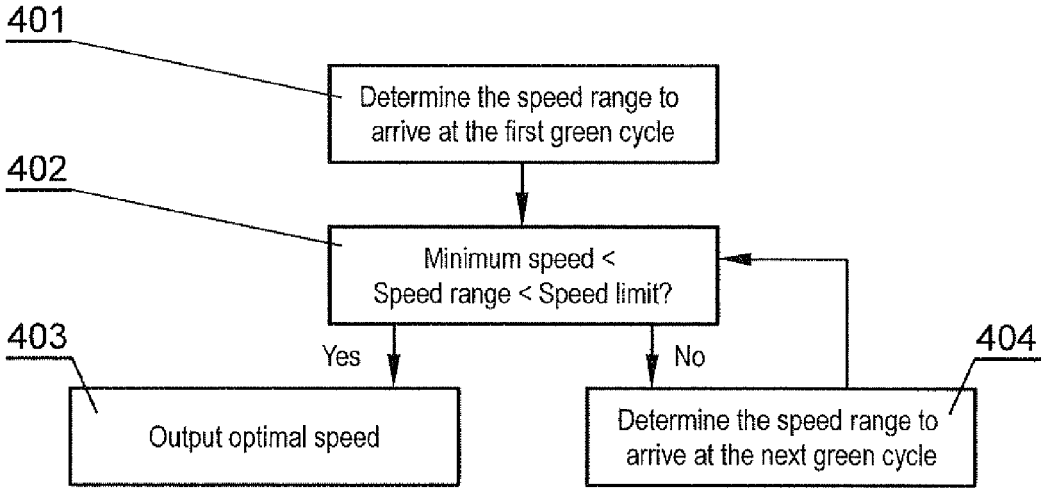
FIG. 3 presents example of the operational information on a traffic light.
FIG. 4A presents a general algorithm for calculating an optimal speed.

An example of a format of operational information on a traffic light is shown in FIG. 3

The system may be organized as a Service Oriented Architecture (SOA). The system may be implemented in Web Services technology, which is a distributed implementation software components provided by SOAP (Simple Object Access Protocol). Service Components of Web Services can be implemented using a variety of programming languages, hardware platforms and operating systems. In order to facilitate implementation of client applications, service components of Web Services are described in WSDL (Web Services Description Language), so that developers of client applications can use automatic generators of communication code. A further development of the solution is UDDI (Universal Description, Discovery and Integration) databases specification allowing to collect information on online Web services available.

A navigation module 110 may have a form of a navigation system installed on board of the vehicle, or a portable device, such as a palmtop or a smartphone. The navigation module 111 comprises a data interface 111 for communicating with the data interface 124 of the server 120 via a communication link 141. The communication 141 may be effected via a dedicated communication channel, or via standard communication channels, such as the Internet.

The navigation module 110 comprises a mapping system 114, which can be a dedicated or third-party system configured to provide a map of the environment. The mapping system 114 may be embedded within the memory of the navigation module or can be accessible via Internet. The mapping system 114 is linked to a geolocalization module 115, such as a Global Positioning System (GPS), that determines geographical coordinates of location of the navigation module 110. The module further comprises a database of traffic lights, defining the coordinates of the traffic lights 130 and their identifiers.

A data processor 112 is configured to determine an optimal speed at which the vehicle 100 should move to arrive at the closest traffic light 130 when it is at green phase.

The optimal speed can be calculated based on the general algorithm shown in FIG. 4A. It starts in step 401 by determining the speed range at which the vehicle may reach the first green cycle of the traffic light, i.e. the current cycle if the traffic light is currently green or the next green cycle. Next, in step 402 the determined range is compared with a speed limit, which can be the lowest of:

- the maximum allowed speed limit for the vehicle, e.g. 130 km/h for passenger cars, 90 km/h for trucks, 30 km/h for bicycles etc.
- a default speed limit set by the system, e.g. 50 km/h;
- the maximum allowed speed limit determined by the mapping system 114 for the particular road region between the vehicle 100 and the closest traffic light 130;
- the average speed determined by the history database 122 for travel between the particular road region between the vehicle 100 and the traffic light 130 (which can be further dependent on the day of the week and time of day).

In case the speed range includes a value lower than the speed limit, an optimal speed is selected and provided to the user in step 403. In case the whole speed range exceeds the speed limit, in step 404 the speed range to arrive at the next green cycle for the particular traffic light 130 is determined and the procedure returns to step 402.

The optimal speed in step 403 can be selected as one of:

- the average between the lowest value of the optimal speed range and the speed limit;
- the speed limit decreased by a predetermined value, such as 5 km/h or 10%;
- the speed limit.

A skilled person will realize that the algorithm of FIG. 4A may be improved by determining the optimal speed that will allow the vehicle to reach the green cycle at the closest traffic light and at the next traffic light. The next traffic light can be determined as the traffic light that is next in the direction of travel or a traffic light that is next on the route of travel planned in the mapping system 114.

Figure 4B:
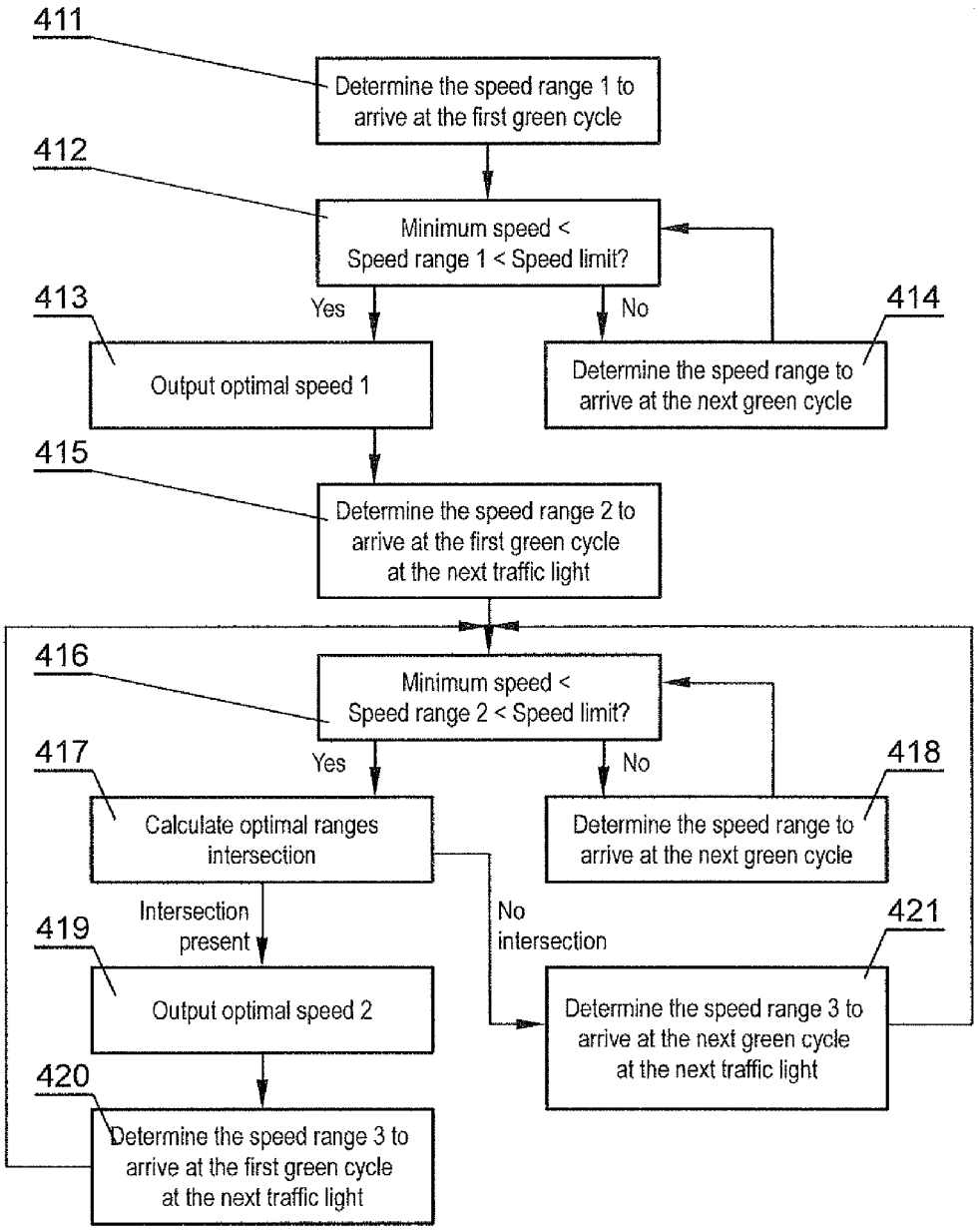
FIG. 4B presents an algorithm for calculating an optimal speed for a plurality of traffic lights.

FIG. 4B presents an algorithm for calculating an optimal speed for a plurality of traffic lights. Steps 411-414 are equivalent to steps 401-404 of FIG. 4A. Speed range 1 is the first speed range determined in step 411 that is between the minimum speed and the speed limit. Preferably, the highest speed of speed range 1 is output in step 413. Next, in step 415 a second speed range is determined to arrive at the first green cycle at the next traffic light. In step 416 it is checked whether this speed range is within the speed limit and if not, the speed range is recalculated in step 418 for the following green cycle. If the speed range is within the speed limit, it is checked in step 419 whether the speed ranges calculated so far for all traffic lights have an intersection range. If there is an intersection range, in step 419 the optimal range is output and in step 420 a further speed range is calculated for a further traffic light. If the range is In case there is no intersection range, in step 421 the procedure determines speed range to arrive at the next green cycle at the next traffic light. The procedure continues until the most optimal speed is found for a determined plurality of traffic lights.

The optimal speed may be calculated for a plurality of alternative routes in a GPS navigation system and the route with the highest optimal speed may be determined to be shown to the user as the optimal route.

Figure 5:
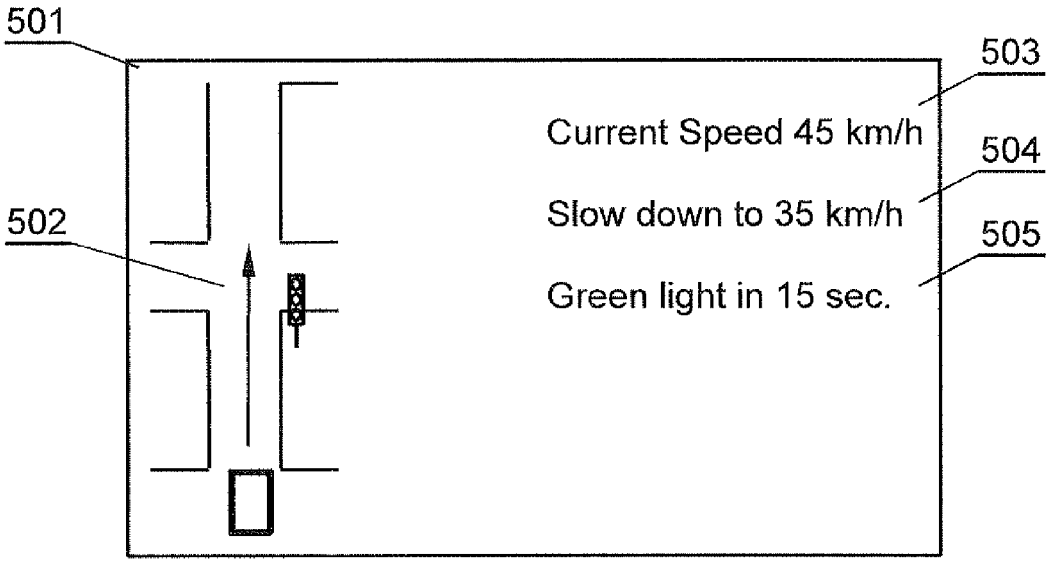
FIG. 5 presents an example of a user interlace.

The optimal speed is displayed via a user interface 113, which may have a form as shown for example in FIG. 5. The user interface 501 may comprise a region displaying a map of the environment 502 and speed information 503, the speed information including information about the current speed 504, the optimal speed 505 and the traffic light cycle information 506 about when the next green cycle will start or how long will the green cycle last. Additional visual feedback may be provided, e.g. by highlighting the background of the interface, for example:

- to green if the current speed is within the calculated speed range or optimal speed;
- to red if the current speed is higher than the calculated speed range or optimal speed;
- to blue if the current speed is lower than the calculated speed range or optimal speed.

The additional feedback may also include comments such as "speed up" or "slow down".

In case the vehicle moves with a speed which is less than the calculated speed range or optimal speed for a relatively long period, it may suggest that the road is under heavy traffic conditions and it is not possible to achieve the expected optimal speed. In such a case the current speed may be used in step 402 as the speed limit to calculate the more optimal speed limit.

The procedures of FIG. 4A or 4B are preferably executed cyclically, e.g. every second, in order to provide to the user the most up-to-date information. The information may have to be updated due to the change of user's speed or a change of the traffic light cycle when adaptive traffic lights are used.

A skilled person will realize that the algorithms of FIGS. 4A and 4B may be adapted to take into account the timing of orange light, i.e. the periods between the green and red lights, without departing from the general inventive concept presented herein.

In order to maintain reliable service, in case of a remote database 101, a query result may also comprise a time stamp defining the time, at which it has been generated. The navigational module may then determine the time lag between the time at which the information about the light cycle was generated at the server 120 and at which is was actually processed by the data processor 112.

In case the traffic information server provides information that a particular traffic light is non-functioning, a special alert may be displayed to the user upon entering the area in the vicinity of that traffic light, so as to warn the user about possible dangerous road situations.

It can be easily recognized, by one skilled in the art, that the aforementioned method for providing traffic information may be performed and/or controlled by one or more computer programs. Such computer programs are typically executed by utilizing the computing resources in a computing device such as personal computers, personal digital assistants, cellular telephones, receivers and decoders of digital television or the like. Applications are stored in non-volatile memory, for example a flash memory or volatile memory, for example RAM and are executed by a processor. These memories are exemplary recording media for storing computer programs comprising computer-executable instructions performing all the steps of the computer-implemented method according the technical concept presented herein.

In another embodiment the aforementioned method for vehicle management in traffic conditions may be performed and/or controlled by one or more specialized hardware modules wherein the logic of the present invention is embedded in programmable hardware circuits such as field-programmable gate array (FPGA). This would specially configure the device to execute functions presented in the foregoing specification.

While the concept presented herein has been depicted, described, and has been defined with reference to particular preferred embodiments, such references and examples of implementation in the foregoing specification do not imply any limitation on the concept. It will, however, be evident that various modifications and changes may be made thereto without departing from the broader scope of the technical concept. The presented preferred embodiments are provided as an example only, and are not exhaustive of the scope of the technical concept presented herein.

Accordingly, the scope of protection is not limited to the preferred embodiments described in the specification, but is only limited by the claims that follow. Any combination of the appended claims in envisaged in the present application.

The invention claimed is:

1. A computer-implemented method for providing traffic information via a navigation module onboard a moving vehicle, comprising the steps of:

obtaining geolocalization data of the vehicle from a geolocalization module;

identifying the closest traffic light ahead the vehicle;

retrieving, from a remote traffic light server, by means of a data interface, operational information on the identified closest traffic light;

processing, by a data processor, the operational information to determine an optimal speed at which the vehicle should move to arrive at the closest traffic light when it is at green phase; and outputting the optimal speed via a user interface of the navigation module;

wherein the step of identifying the closest traffic light ahead the vehicle is executed using local information provided by an onboard mapping system configured to identify the closest traffic light whereas the mapping system further comprises a database of traffic lights, defining the coordinates of the traffic lights and their identifiers facilitating said identification.

2. The method according to claim 1, wherein the optimal speed is determined by:

determining the speed range necessary to arrive at the closest traffic light at a current cycle if the traffic light is currently green or the next green cycle;

comparing the speed range with a speed limit;

in case the speed range includes a range lower than the speed limit, determining the optimal speed as not greater than the speed limit; and otherwise, determining the speed range necessary to arrive at the next green cycle of the closest traffic light.

3. The method according to claim 2, wherein the optimal speed is further determined by:

determining a second speed range necessary to arrive at the first green cycle of the next traffic light;

comparing the second speed range with a speed limit;

in case the second speed range includes a range lower than the speed limit, determining the second optimal speed as not greater than the speed limit and outputting an optimal speed which is in the range of intersection of the first speed range and the second speed range; and otherwise, determining the speed range necessary to arrive at the next green cycle of the closest traffic light.

4. The method according to claim 2, wherein the speed limit is selected depending on the type of the vehicle.

5. The method according to claim 2, wherein the speed limit is determined as the maximum allowed speed limit determined by a mapping system for the particular road region between the vehicle and the closest traffic light.

6. The method according to claim 2, wherein the speed limit is determined as an average speed stored in a history database for travel between the particular road region between the vehicle and the traffic light.

7. The method according to claim 1, wherein the optimal speed is determined by determining the optimal speed as a speed within a range necessary to arrive at the green cycle of the closest traffic light and the next traffic light.

8. The method according to claim 1, further comprising outputting, via a user interface of the navigation module, an indicator specifying whether the current speed is within the calculated speed range, lower than the determined speed range or higher than the determined speed range.

9. The method according to claim 1 being operated cyclically.

10. A computer readable medium storing computer-executable instructions performing all the steps of the computer-implemented method according to claim 1 when executed on a computer.

11. A navigation module for providing traffic information for a moving vehicle, the module comprising:

a geolocalization module configured to provide geolocalization data of the vehicle;

a data interface communicatively connected to a remote traffic light server, and configured to retrieve operational information on the identified closest traffic light;

a data processor configured to process the operational information to determine an optimal speed at which the vehicle should move to arrive at the closest traffic light when it is at green phase;

a user interface configured to output the optimal speed;

a mapping system configured to identify the closest traffic light ahead the vehicle wherein the mapping system further comprises a database of traffic lights, defining the coordinates of the traffic lights and their identifiers facilitating said identification.

* * * * *